US007338251B2

(12) United States Patent
Ro et al.

(10) Patent No.: US 7,338,251 B2
(45) Date of Patent: Mar. 4, 2008

(54) TURBO COMPRESSOR

(75) Inventors: Soo-hyuk Ro, Seoul (KR); Cheol-woo Kim, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 157 days.

(21) Appl. No.: 11/029,424

(22) Filed: Jan. 6, 2005

(65) Prior Publication Data

US 2005/0152786 A1 Jul. 14, 2005

(30) Foreign Application Priority Data

Jan. 8, 2004 (KR) ..... 10-2004-0001085

(51) Int. Cl.
*F04D 29/26* (2006.01)

(52) U.S. Cl. ..... 415/58.3; 415/58.6; 415/173.1; 415/914

(58) Field of Classification Search ..... 415/55.3, 415/57.1, 58.3, 58.6, 151, 159, 173.1, 208.3, 415/914

See application file for complete search history.

(56) References Cited

U.S. PATENT DOCUMENTS 3,893,787 A * 7/1975 Jones ..... 415/228
5,555,956 A * 9/1996 Voss et al. ..... 184/6.16
6,554,568 B2 4/2003 Fledersbacher et al.
6,582,189 B2 * 6/2003 Irie et al. ..... 415/119

FOREIGN PATENT DOCUMENTS

| | | |
|---|---|---|
| JP | 6-193596 | 7/1994 |
| JP | 10-141293 | 5/1998 |
| KR | 2000-3085 | 1/2000 |
| KR | 2000-65622 | 11/2000 |
| KR | 2001-81648 | 8/2001 |
| KR | 2001-81649 | 8/2001 |

OTHER PUBLICATIONS

Chinese Patent Office Action issued with respect to Chinese Application No. 2004100593342, which corresponds to the above-reference application.

* cited by examiner

*Primary Examiner*—Edward K. Look
*Assistant Examiner*—Dwayne J White
(74) *Attorney, Agent, or Firm*—Staas & Halsey LLP

(57) ABSTRACT

A turbo compressor comprising a driving motor, an impeller to be rotated by the driving motor, a second gas suction part through which gas is introduced into the impeller, and a discharger through which the gas is discharged from the impeller, the turbo compressor comprises a shroud provided between the gas suction part and the gas discharger and spaced from a blade of the impeller; and a plurality of channels provided on the shroud and inclined toward the gas discharger along a rotating direction of the impeller. With this configuration, the present invention provides a turbo compressor in which compression efficiency is increased by eliminating a backflow and a leakage flow.

16 Claims, 8 Drawing Sheets

TURBO COMPRESSOR

CROSS-REFERENCE TO RELATED APPLICATIONS

This application claims the benefit of Korean Patent Application No. 2004-1085, filed Jan. 8, 2004, in the Korean Intellectual Property Office, the disclosure of which is incorporated herein by reference.

BACKGROUND OF THE INVENTION

1. Field of the Invention

The present invention relates to a turbo compressor, and more particularly, to a turbo compressor having an improved structure to eliminate a leakage flow between an impeller and a shroud.

2. Description of the Related Art

Generally, a turbo compressor comprises a driving motor, an impeller to be rotated by the driving motor, and a shroud spaced from a blade of the impeller. The turbo compressor sucks and compresses gas such as a refrigerant by a centrifugal force due to rotation of the impeller accommodated in the shroud.

The driving motor comprises a stationary stator mounted in a motor chamber, and a rotor rotatably provided inside the stator. The rotor is integrally connected to the impeller by a rotating shaft, and rotates integrally with the impeller.

FIGS. 1 through 3 are sectional and perspective views illustrating an impeller and a shroud provided in a conventional turbo compressor. As shown therein, the conventional turbo compressor comprises a rotating shaft 105 rotating integrally with a driving motor (not shown), an impeller 140 connected to and rotating with the rotating shaft 105, a shroud 160 shrouding the impeller 140 and spaced from the impeller 140, a gas suction part 145 communicating with a first side of the shroud 160 and through which gas is introduced into the impeller 140, and a diffuser 147 communicating with a second side of the shroud 160 and transforming kinetic energy of the gas drawn by the impeller 140 into compression energy.

The impeller 140 comprises an impeller body 141 connected to the rotating shaft 105, and a plurality of blades 143 formed on the impeller body 141 and spaced from the shroud 160.

With respect to a diffusing flow "c" from the gas suction part 145 to the diffuser 147, a gas backflow from the diffuser 147 to the gas suction part 145 is generated through a space 165 because pressure in the gas suction part 145 is relatively low as compared with the pressure in the diffuser 147. Therefore, the shroud 160 is provided with a plurality of backflow prevention grooves 161 to prevent the gas backflow.

The plurality of backflow prevention grooves 161 are annularly provided on the inside circumferential surface of the shroud 160 along a rotating direction of the impeller 140, and are spaced from each other. That is, the backflow prevention grooves 161 are formed as annular grooves having different diameters from each other, and are formed on the inside circumferential surface of the shroud 160, being centered on a rotating axis of the impeller 140.

Thus, the conventional turbo compressor is provided with the plurality of the backflow prevention grooves 161 on the shroud 160, so that the backflow prevention grooves 161 accommodate the gas flowing from the diffuser 147 to the gas suction part 145 along the inside circumference surface of the shroud 160 to prevent the backflow "a" as shown in FIG. 1.

Further, as shown in FIG. 3, velocity and friction of the drawn gas are different according to the rotating direction of the impeller 140 and a shape of a passage between the blades 143, and therefore the velocity difference and the friction difference cause pressures to be differently applied to opposite sides of each blade 143. Such pressure difference in the opposite sides of each blade 143 causes a leakage flow "b", from a first side of the blade 143 to a second side of the blade 143 across the blade 143, to be generated through the space 165 between the shroud 160 and the blade 143. Also, the leakage flow "b" flows over the adjacent blade 143 across the diffusing flow "c" and affects the diffusing flow "c". The leakage flow thereby decreases compression efficiency.

However, in the conventional turbo compressor, the plurality of backflow prevention grooves are provided in the shroud in order to eliminate the backflow from the diffuser to the gas suction part, but there is nothing to eliminate the leakage flow, so that the compression efficiency is decreased. That is, because the leakage flow flows along the rotating direction of the impeller, the backflow prevention grooves formed along the rotating direction of the impeller cannot eliminate the leakage flow. Accordingly, to increase the compression efficiency, there is needed to eliminate both the backflow and the leakage flow.

SUMMARY OF THE INVENTION

Accordingly, an aspect of the present invention provides a turbo compressor improved in compression efficiency.

The foregoing and/or other aspects of the present invention are achieved by providing a turbo compressor comprising a driving motor, an impeller to be rotated by the driving motor, a second gas suction part through which gas is introduced into the impeller, and a discharger through which the gas is discharged from the impeller. The turbo compressor further comprises a shroud provided between the gas suction part and the gas discharger and spaced from a blade of the impeller, and a plurality of channels provided on the shroud and inclined toward the gas discharger along a rotating direction of the impeller.

According to another aspect of the invention, the plurality of channels is provided on a gas discharging area of the shroud adjacent to the gas discharger.

According to another aspect of the invention, the adjacent channels are spaced from each other in a gas discharging direction and overlap each other.

According to another aspect of the invention, the turbo compressor further comprises at least one auxiliary channel placed on the shroud between the gas suction part and the plurality of channels, and along the rotating direction of the impeller.

According to another aspect of the invention, the channels and the auxiliary channels are recessed on the shroud.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
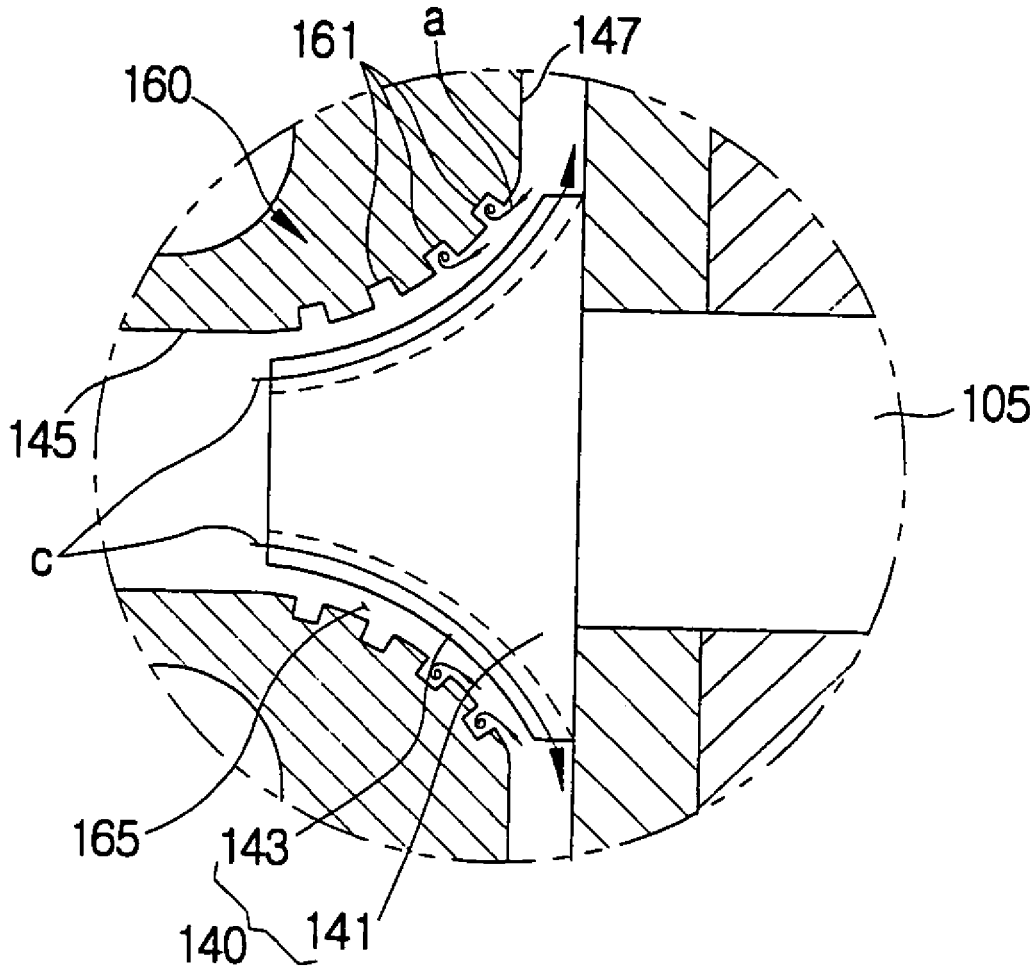
FIG. 1 (PRIOR ART)
FIG. 1 is a sectional view of an impeller and a shroud provided in a conventional turbo compressor.
Figure 2:
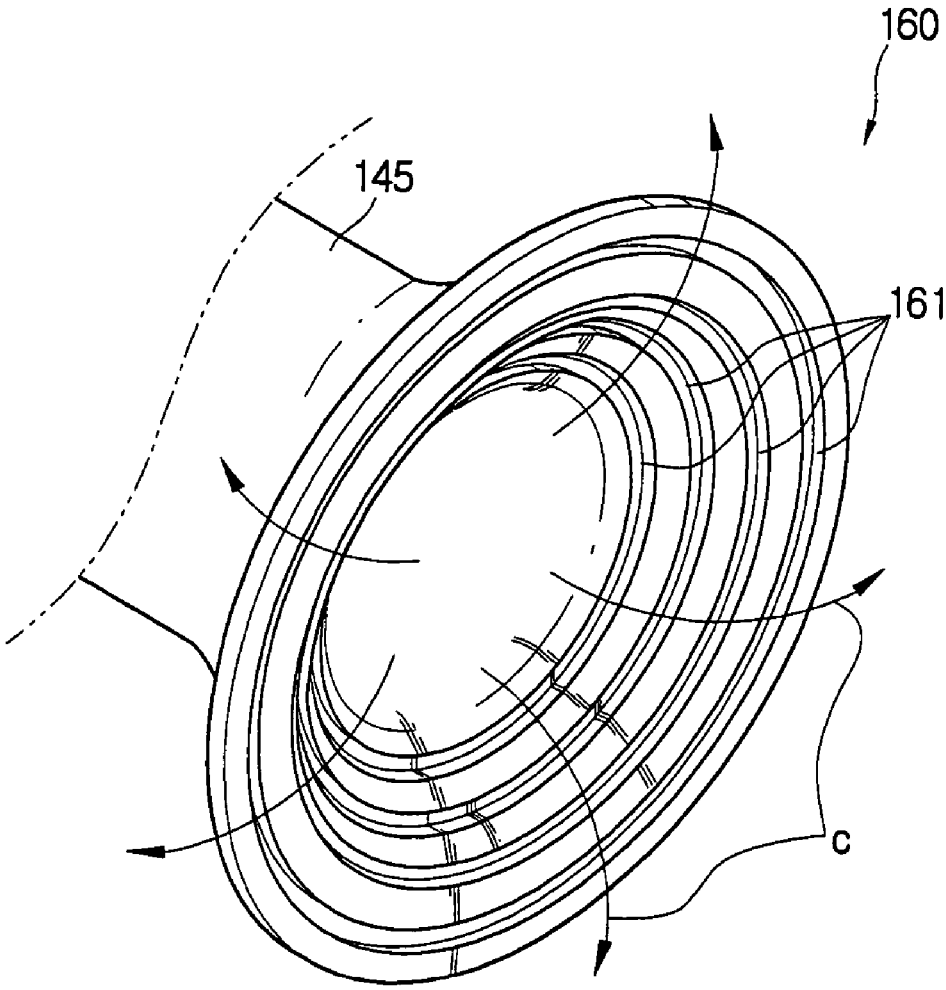
FIG. 2 (PRIOR ART)
FIG. 2 is a perspective view of the impeller of FIG. 1.
Figure 3:
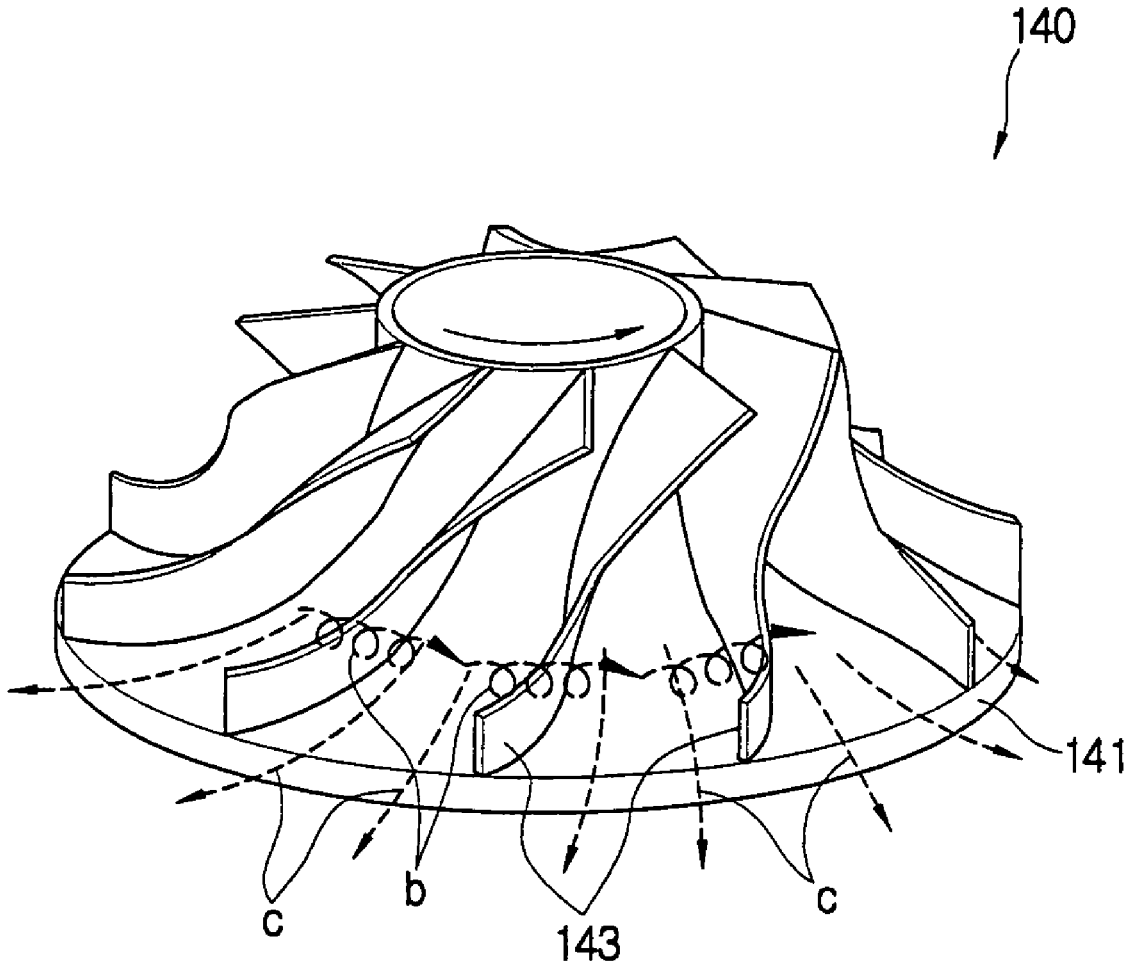
FIG. 3 (PRIOR ART)
FIG. 3 is a perspective view of the shroud of FIG. 1.
Figure 4:
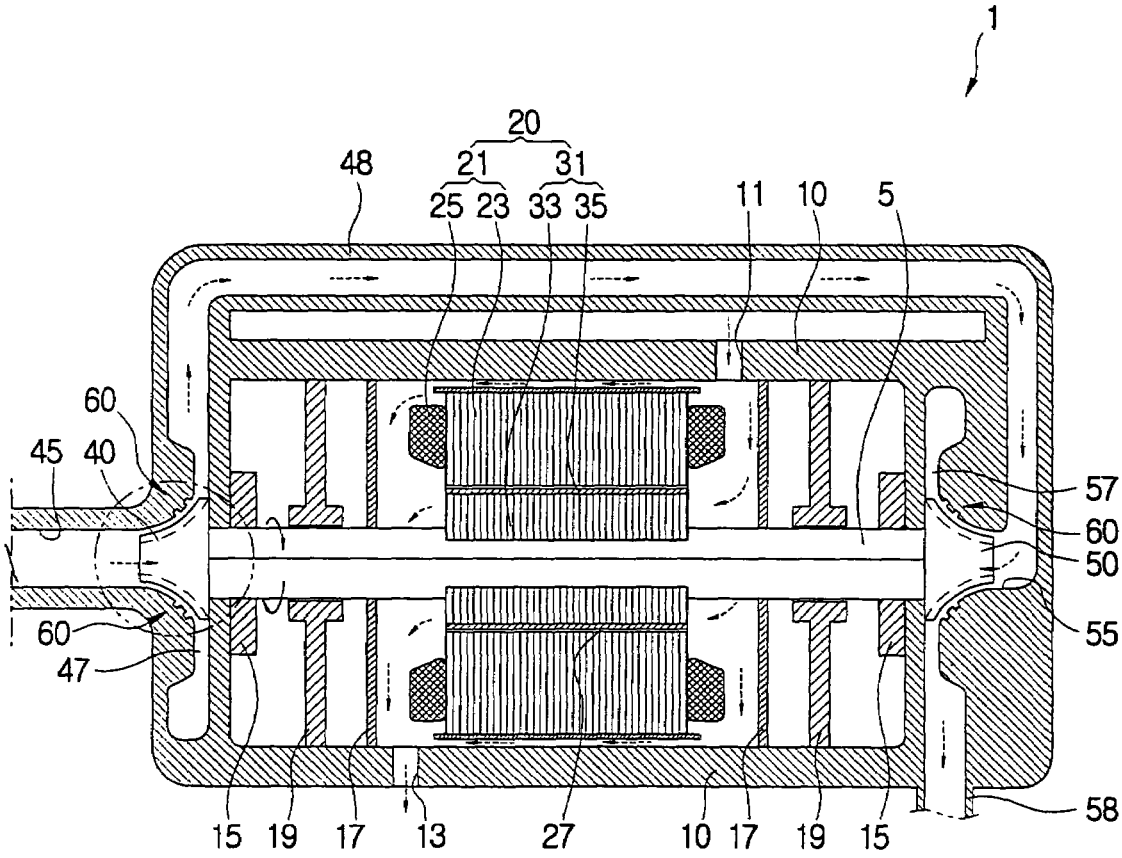
FIG. 4 is a schematic sectional view of a turbo compressor according to a first embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

As shown in FIGS. 4 through 7, a turbo compressor 1 according to a first embodiment of the present invention comprises a driving motor 20 mounted in a motor casing 10; first and second impellers 40 and 50 connected to a rotating shaft 5 of the driving motor 20 and rotating integrally with the rotating shaft 5; a pair of shrouds 60 shrouding and spaced apart from the first and second impellers 40 and 50; first and second gas suction part 45 and 55 communicating with a first side of each shroud 60 and through which gas, such as a refrigerant, is introduced into the impellers 40 and 50; first and second diffusers 47 and 57, as a gas discharger, communicating with a second side of each shroud 60 and transforming kinetic energy of the gas drawn by the impellers 40 and 50 into compression energy; and a gas connector 48 between the first diffuser 47 and the second gas suction part 55 and introducing the gas diffused by the first diffuser 47 into the second gas suction part 55. Further, the second diffuser 57 is provided with a gas discharger 58 to discharge a compressed gas.

The motor casing 10 comprises a predetermined accommodating space to accommodate the driving motor 20 and the rotating shaft 5, a cooling gas suction part 11 formed in a first side of the motor casing 10 and through which a cooling gas is introduced to cool the driving motor 20, and a cooling gas discharger 13 formed in a second side of the motor casing 10 and through which the cooling gas, introduced from the cooling gas suction part 11, is discharged after cooling the driving motor 20. Further, the motor casing 10 comprises opposite lateral sides coupled with the rotating shaft 5 to support the rotating shaft 5. In addition, a sealing member 15 is provided at a place where the motor casing 10 is coupled with the rotating shaft 5 in order to prevent an inflow of the compressed gas into the inside of the motor casing 10.

The rotating shaft 5 comprises opposite ends which are respectively connected to the first and second impeller 40 and 50, and a middle portion connected to a rotor 31 of the driving motor 20 and rotating integrally with the rotor 31. Further, in an embodiment of the invention, the rotating shaft 5 is coupled with a thrust bearing 17 to support the rotating shaft 5 in a direction of a rotating axis, and a radial bearing 19 to support the rotating shaft 5 in a radial direction.

The driving motor comprises a stator 21, which is integrally mounted to the motor casing 10, and a rotor 31, which is rotatably inserted in the stator 21 and spaced from the stator 21.

The stator 21 comprises a stator core 23 having a cylindrical shape formed with a rotor housing 27 to accommodate the rotor 31, and a multiple coil 25 coupled to the stator core 23.

The rotor 31 is shaped like a cylinder and is inserted in the rotor housing 27. Within the rotor housing 27, the rotor 31 is separated from the rotor housing 27. Further, the rotor 31 comprises a rotor core 33 formed by lamination of a plurality of core sheets, and a holder 35 to support each core sheet provided in the rotor core 33. Thus, the rotating shaft 5 is inserted in the center of the rotor core 33 of the rotor 31, and rotated integrally with the rotor 31.

Here, the first impeller 40 and the shroud 60 shrouding the first impeller 40 has a structure similar to the second impeller 50 and the shroud 60 shrouding the second impeller 50. The structure of the first impeller 40 and the shroud 60 shrouding the first impeller 40 will be representatively described hereinbelow.

The first impeller 40 comprises an impeller body 41 connected to the rotating shaft 5, and a plurality of blades 43 formed on the impeller body 41 and spaced from the shroud 60.

In an embodiment of the invention, the impeller body 41 has a frustoconical shape, and has a first side into which the rotating shaft 5 is integrally inserted. The first side therefore rotates integrally with the rotating shaft 5.

The plurality of blades 43 are formed on a second side of the impeller body 41 at regular intervals. Each blade 43 is curved to draw the gas from the first gas suction part 45 to the first diffuser 47. However, it should be appreciated that the plurality of blades are formed on the second side of the impeller body 41 without curvature.

The shroud 60 is placed between the first gas suction part 45 and the first diffuser 47, being spaced from the blade 43 of the first impeller 47. Further, the shroud 60 is formed with a plurality of channels 61 inclined toward the first diffuser 47 along a rotating direction of the impeller 40 in order to eliminate a backflow "a" and a leakage flow "b".

Figure 5:
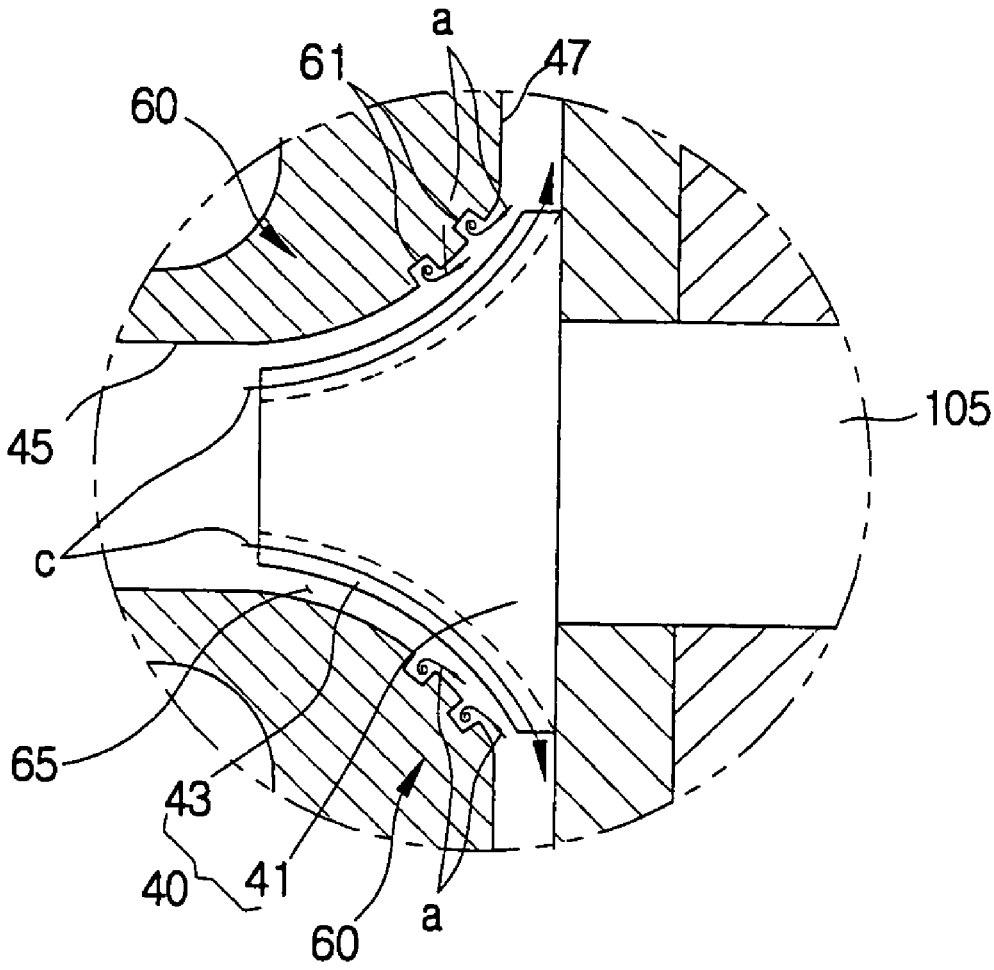
FIG. 5 is a partially enlarged sectional view of the turbo compressor of FIG. 4.

As shown in FIG. 5, the backflow "a" occurs as a gas flows from the first diffuser 47, in which pressure is relatively high, to the first gas suction part 45, in which pressure is relatively low, along the shroud 60 as a result of the pressure difference between the first diffuser 47 and the first gas suction 45. Such backflow interrupts a diffusing flow "c" in which the gas flows from the first gas suction part 45 to the first diffuser 47 via the first impeller 40, thereby decreasing compression efficiency. Further, drawn gas on opposite sides of each blade 43 provided in the first impeller 40 have different velocities, frictional properties, etc. according to the rotating direction of the first impeller 40. Therefore, gas pressures are applied differently to the opposite sides of each blade 43. As a result, the pressure difference causes the leakage flow "b" (see FIG. 7), in which the gas flows from a first side of the blade 43 to a second side of the blade 43 across the blade 43, to be generated through a space 65 between the shroud 60 and the blade 43. Such leakage flow "b" flows over the adjacent blade 43 across the diffusing flow "c" and affects the diffusing flow "c", thereby decreasing the compression efficiency.

Figure 6:
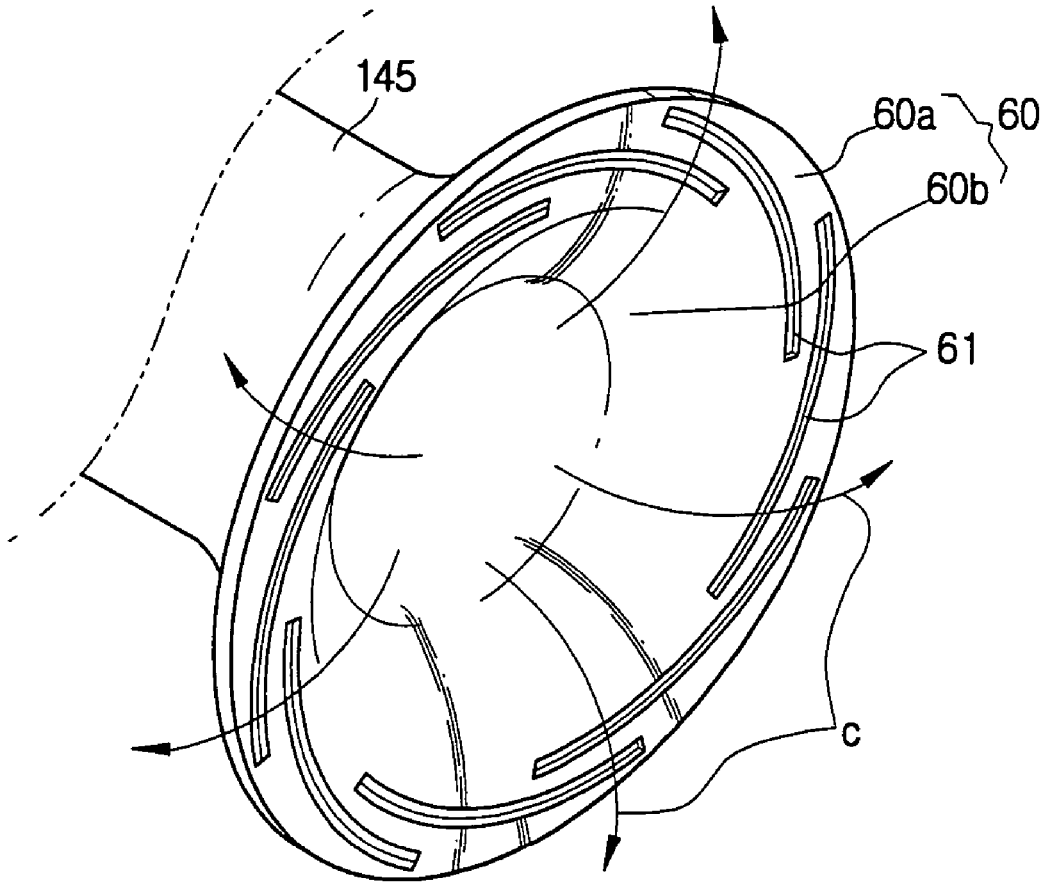
FIG. 6 is a perspective view of a shroud of FIG. 4.

In an embodiment of the invention, as shown in FIG. 6, the plurality of channels 61 is provided on a gas discharging area 60*a* of the shroud 60 adjacent to the first diffuser 47 as opposed to a gas suction area 60*b* of the shroud 60 adjacent to the first gas suction. The reason why the channels 61 are provided on the gas discharging area 60*a* is that most of the backflow "c" and the leakage flow "b" appears on the gas discharging area 60*a* of the shroud 60. However, the plurality of channels 61 may be provided on the whole inside circumference surface of the shroud 60 including the gas suction area 60*b* as well as the gas discharging area 60*a*.

In an embodiment of the invention, the adjacent channels 61 are spaced from each other in a direction of the diffusing flow "c" and overlap each other. That is, as shown in FIG. 6, the adjacent channels 61 overlap each other to effectively eliminate the backflow "a" and the leakage flow "b" at opposite ends of each channel 61.

In an embodiment of the invention, each channel 61 has a curved shape. That is, as shown in FIG. 6, each channel 61 defines an arc with respect to the direction of the diffusing flow "c". This allows the leakage flow "b", generated in the opposite sides of the blade 43 of the first impeller 40 to the first diffuser 47 through the plurality of channels 61, to be discharged.

According to an aspect of the invention, each channel 61 is recessed on the inside circumference surface of the shroud 60. Further, each channel 61 has a rectangular section, but may have a semicircular section, etc. Further, each channel 61 has a width, which is wide enough to eliminate the backflow "a" and the leakage flow "b", wherein the width of the channel 61 may vary according to the size, the rotating speed, etc. of the first impeller 40.

With this configuration, the first impeller 40 and the shroud 60 of the turbo compressor 1 according to the first embodiment of the present invention are operated as follows.

Figure 7:
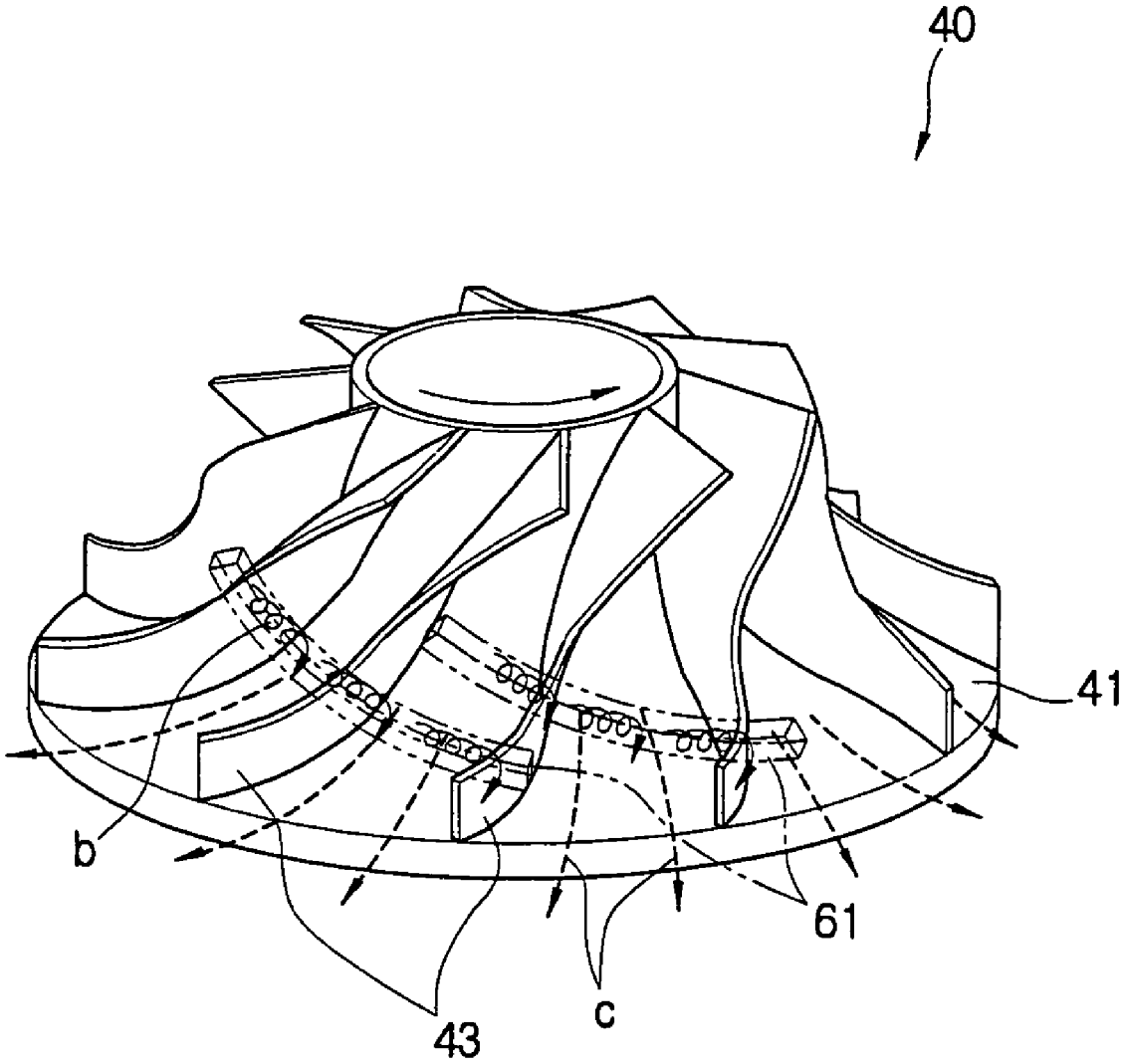
FIG. 7 is a perspective view illustrating gas flowing in an impeller and a channel of the turbo compressor according to the first embodiment of the present invention.

First, the driving motor 20 is turned on and rotates the rotating shaft 5. Then, the first impeller 40 is rotated integrally with the rotating shaft 5, so that the rotation of the first impeller 40 causes the gas to flow from the first gas suction part 45 to the first diffuser 47. At this time, as shown in FIG. 5, the backflow "a" from the first diffuser 47 to the first gas suction part 45 due to the pressure difference between the first diffuser 47 and the first gas suction part 45 is accommodated in the plurality of channels 61, thereby eliminating the backflow "a". Also, as shown in FIG. 7, the leakage flow "b" due to the pressure difference between the opposite sides of the blade 43 of the impeller 40 is accommodated and flows toward the first diffuser 47 along a lengthwise direction of each channel 61, thereby eliminating the leakage flow "b" from flowing across the diffusing flow "c".

Thus, the plurality of channels 61 is provided on the shroud 60 and is inclined toward the first diffuser 47 in the rotating direction of the impeller 40, and the leakage flow "b" as well as the backflow "a" are substantially eliminated.

Figure 8:
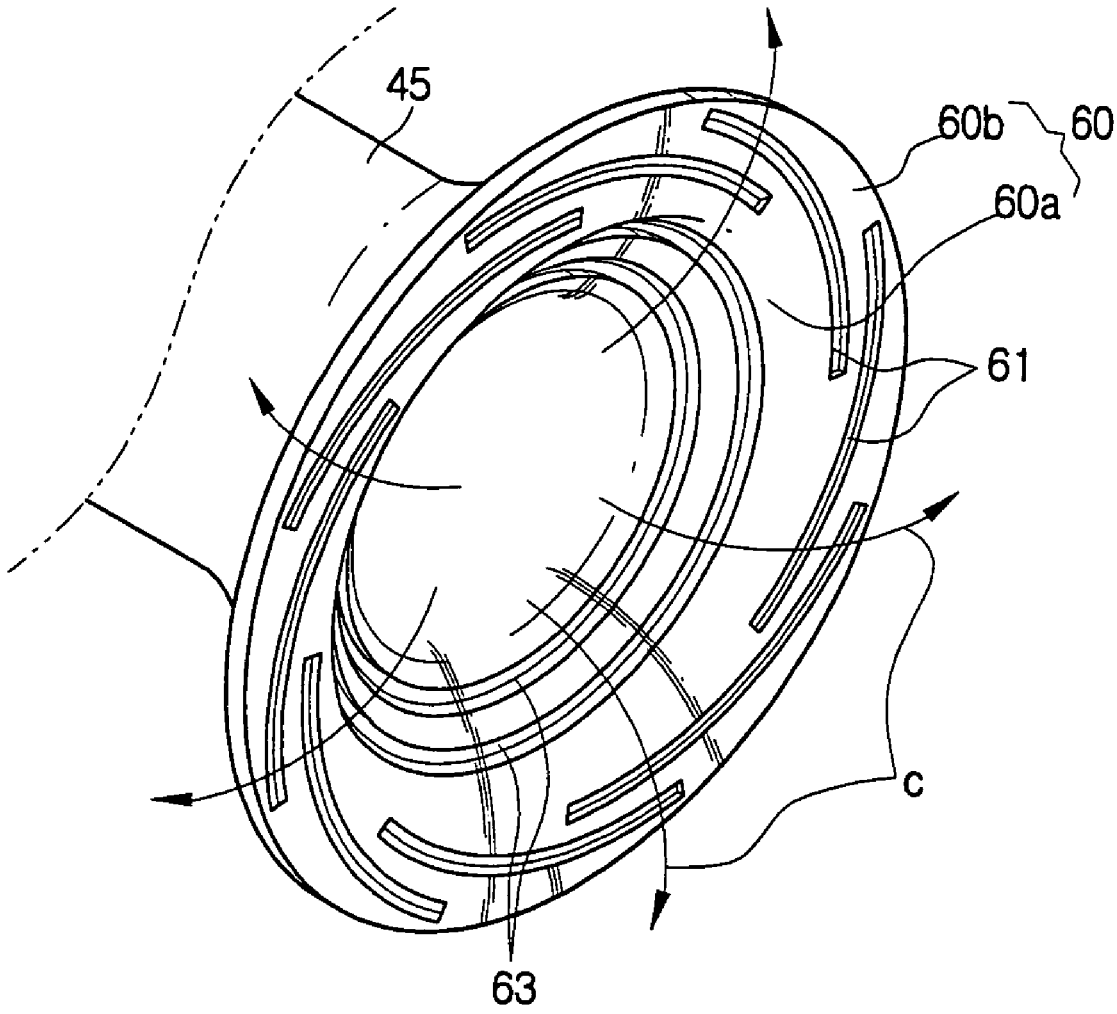
FIG. 8 is a perspective view of a shroud provided in a turbo compressor according to a second embodiment of the present invention.

FIG. 8 is a perspective view of a shroud provided in a turbo compressor according to a second embodiment of the present invention. As shown therein, the shroud 60 according to the second embodiment further comprises at least one auxiliary channel 63 placed between the first gas suction part 45 and the plurality of channels 61 and arranged along the rotating direction of the first impeller 40.

The plurality of auxiliary channels 63 is annularly provided along the rotating direction of the impeller 40 in a front of the shroud 60, which is formed with the channels 61, wherein the auxiliary channels 63 are spaced from each other. That is, the auxiliary channels 63 are provided in the gas suction area 60*b* of the shroud 60 in front of the channels 61 provided in the gas discharging area 60*a* of the shroud 60. Further, the auxiliary channels 63 are recessed on the inside circumference surface of the shroud 60, having diameters different from each other concentrically on a rotating axis of the impeller 140.

Thus, in the turbo compressor according to the second embodiment of the present invention, the plurality of auxiliary channels 63 are additionally provided on the shroud 60, so that the backflow is eliminated even when the backflow "a" from the first diffuser to the first gas suction part 45 flows over the channels 61.

In the above descriptions, the channels 61 and the auxiliary channels 63 are applied to the first impeller 40 and the shroud 60 shrouding the first impeller 40, but it should be appreciated that the channels 61 and the auxiliary channels 63 are applied to the second impeller 50 and the shroud 60 shrouding the second impeller 50.

As described above, the present invention provides a turbo compressor in which compression efficiency is increased by eliminating a backflow and a leakage flow.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A turbo compressor comprising a driving motor, an impeller having a blade, to be rotated by the driving motor, a gas suction part through which gas is introduced into the impeller, and a discharger through which the gas is discharged from the impeller, the turbo compressor comprising:

a shroud between the gas suction part and the gas discharger and spaced from the blade of the impeller; and a plurality of channels separately on the shroud extending primarily in a rotating direction of the impeller and inclined secondarily toward the gas discharger and displaced relative to each other in a radial direction of the shroud.

2. A turbo compressor comprising a driving motor, an impeller having a blade, to be rotated by the driving motor, a gas suction part through which gas is introduced into the impeller, and a discharger through which the gas is discharged from the impeller, the turbo compressor comprising:

a shroud between the gas suction part and the gas discharger and spaced from the blade of the impeller; and a plurality of channels on the shroud and inclined toward the gas discharger along a rotating direction of the impeller, wherein the plurality of channels is provided on a gas discharging area of the shroud adjacent to the gas discharge.

3. The turbo compressor according to claim 1, wherein of the plurality of channels are separated from and overlapped with each other in a gas discharging direction.

4. The turbo compressor according to claim 1, wherein each of the plurality of channels has a curved shape.

5. A turbo compressor comprising a driving motor, an impeller having a blade, to be rotated by the driving motor, a gas suction part through which gas is introduced into the impeller, and a discharger through which the gas is discharged from the impeller, the turbo compressor comprising:

a shroud between the gas suction part and the gas discharger and spaced from the blade of the impeller;

a plurality of channels on the shroud and inclined toward the gas discharger along a rotating direction of the impeller; and an auxiliary channel, placed on the shroud between the gas suction part and the plurality of channels, to be arranged along the rotating direction of the impeller.

6. The turbo compressor according to claim 5, wherein the channels and the auxiliary channels are recessed on the shroud.

7. A turbo compressor including an impeller, a gas suction through which gas is introduced into the impeller, and a discharger through which the gas is discharged from the impeller, the turbo compressor comprising:

a blade along an outer surface of the impeller;

a shroud, having a first side at a beginning of an air flow channel and a second side at an end of the air flow channel, above and proximate to the blade of the impeller; and a plurality of channels, separately depressed into an outer surface of the shroud extending primarily in a rotating direction of the impeller and inclined secondarily toward the gas discharger and displaced relative to each other in a radial direction of the shroud, wherein the impeller has a substantially frustoconical shape.

8. The turbo compressor according to claim 7, wherein the turbo compressor includes an additional impeller and an additional shroud, the additional shroud having a first side at a beginning of an air flow channel and a second side at and end of the air flow, to correspond with the additional impeller.

9. The turbo compressor according to claim 8, further comprising:

a motor casing;

a driving motor, having a rotating shaft, mounted in the motor casing;

additional gas suctions, through which gas is introduced to the impellers, to communicate with the first sides of the shrouds;

additional diffusers to communicate with the second sides of the shrouds and to transform kinetic energy of the gas into compression energy; and a gas communicator to introduce gas from the diffusers to the gas suctions.

10. A turbo compressor including an impeller, a gas suction through which gas is introduced into the impeller, and a discharger through which the gas is discharged from the impeller, the turbo compressor comprising:

a blade along an outer surface of the impeller;

a shroud, having a first side at a beginning of an air flow channel and a second side at an end of the air flow channel, above and proximate to the blade of the impeller;

a plurality of channels, depressed into an outer surface of the shroud, extending primarily in a rotating direction of the impeller and which are inclined secondarily toward the discharger and displaced relative to each other in a radial direction of the shroud, wherein the impeller has a substantially frustoconical shape, wherein the turbo compressor includes an additional impeller and an additional shroud, the additional shroud having a first side at a beginning of an air flow channel and a second side at and end of the air flow channel, to correspond with the additional impeller;

a motor casing;

a driving motor, having a rotating shaft, mounted in the motor casing;

additional gas suctions, through which gas is introduced to the impellers, to communicate with the first sides of the shrouds;

additional diffusers to communicate with the second sides of the shrouds and to transform kinetic energy of the gas into compression energy; and a gas communicator to introduce gas from the diffusers to the gas suctions, wherein the at least one of the shrouds comprises:

a gas discharging area adjacent to one of the diffusers; and a gas suction area adjacent to one of the gas suctions.

11. A turbo compressor including an impeller, a gas suction through which gas is introduced into the impeller, and a discharger through which the gas is discharged from the impeller, the turbo compressor comprising:

a blade along an outer surface of the impeller:

a shroud, having a first side at a beginning of an air flow channel and a second side at an end of the air flow channel, above and proximate to the blade of the impeller;

a channel, depressed into an outer surface of the shroud, which is inclined toward the gas discharger along a rotating direction of the impeller, wherein the impeller has a substantially frustoconical shape, wherein the turbo compressor includes an additional impeller and an additional shroud, the additional shroud having a first side at a beginning of an air flow channel and a second side at and end of the air flow channel, to correspond with the additional impeller:

a motor casing;

a driving motor, having a rotating shaft, mounted in the motor casing;

additional gas suctions, through which gas is introduced to the impellers, to communicate with the first sides of the shrouds;

additional diffusers to communicate with the second sides of the shrouds and to transform kinetic energy of the gas into compression energy; and a gas communicator to introduce gas from the diffusers to the gas suctions, wherein the at least one of the shrouds comprises:

a gas discharging area adjacent to one of the diffusers; and a gas suction area adjacent to one of the gas suctions, wherein the plurality of channels is provided on the gas discharging area of the at least one of the shrouds.

12. The turbo compressor according to claim 11 wherein the plurality of channels comprises separate channels, which are separated from one another in a direction of a diffusing flow.

13. The turbo compressor according to claim 12, wherein each channel has a curved shape in a direction of the diffusing flow.

14. The turbo compressor according to claim 13, wherein each channel has a substantially rectangular cross section.

15. The turbo compressor according to claim 14, wherein each channel has a substantially semi-circular cross section.

16. A turbo compressor including an impeller, a gas suction through which gas is introduced into the impeller, and a discharger through which the gas is discharged from the impeller, the turbo compressor comprising:

a blade along an outer surface of the impeller;

a shroud, having a first side at a beginning of an air flow channel and a second side at an end of the air flow channel, above and proximate to the blade of the impeller;

a channel, depressed into an outer surface of the shroud, which is inclined toward the gas discharger along a rotating direction of the impeller; and at least one auxiliary channel between the gas suction and the channel, wherein the impeller has a substantially frustoconical shape.

* * * * *

UNITED STATES PATENT AND TRADEMARK OFFICE

CERTIFICATE OF CORRECTION

PATENT NO. : 7,338,251 B2
APPLICATION NO. : 11/029424
DATED : March 4, 2008
INVENTOR(S) : Soo-hyuk Ro et al.

It is certified that error appears in the above-identified patent and that said Letters Patent is hereby corrected as shown below:

Title Pg, Item (56) (Other Publications), Line 2-3, change “reference” to --referenced--.

Column 7, Line 28, change “and” to --an--.

Column 7, Line 29, change “flow,” to --flow channel,--.

Column 8, Line 17, change “impeller:” to --impeller;--.

Column 8, Line 30, change “impeller:” to --impeller;--.

Column 8, Line 48, after “claim 11” insert --,--.

Signed and Sealed this

Fifth Day of August, 2008

JON W. DUDAS
*Director of the United States Patent and Trademark Office*